US010933511B2

(12) United States Patent
Lund et al.

(10) Patent No.: US 10,933,511 B2
(45) Date of Patent: Mar. 2, 2021

(54) POLYCRYSTALLINE DIAMOND CONSTRUCTIONS WITH MODIFIED REACTION ZONE

(71) Applicant: Smith International, Inc., Houston, TX (US)

(72) Inventors: Jeffrey Bruce Lund, Salt Lake City, UT (US); Sharlynn Davis, Provo, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 19 days.

(21) Appl. No.: 16/066,069

(22) PCT Filed: Dec. 11, 2016

(86) PCT No.: PCT/US2016/066050

§ 371 (c)(1),
(2) Date: Jun. 26, 2018

(87) PCT Pub. No.: WO2017/116659

PCT Pub. Date: Jul. 6, 2017

(65) Prior Publication Data

US 2018/0369994 A1 Dec. 27, 2018

Related U.S. Application Data

(60) Provisional application No. 62/271,274, filed on Dec. 27, 2015.

(51) Int. Cl.
*B24D 18/00* (2006.01)
*B24D 99/00* (2010.01)
(Continued)

(52) U.S. Cl.
CPC ..... *B24D 18/0009* (2013.01); *B22F 3/14* (2013.01); *B22F 5/00* (2013.01); *B22F 7/08* (2013.01);
(Continued)

(58) Field of Classification Search
CPC ..... B24D 18/0009; B24D 99/005; B22F 3/14; B22F 5/00; B22F 7/08; B22F 2005/001;
(Continued)

(56) References Cited

U.S. PATENT DOCUMENTS 5,217,081 A 6/1993 Waldenstrom et al.
2010/0104874 A1 4/2010 Yong et al.
(Continued)

FOREIGN PATENT DOCUMENTS

WO WO2005068113 A1 7/2005

OTHER PUBLICATIONS

International Search Report and Written Opinion issued in International Patent application PCT/US2016/066050 dated Mar. 20, 2017. 18 pages.

(Continued)

*Primary Examiner* — Matthew R Buck
*Assistant Examiner* — Patrick F Lambe

(57) ABSTRACT

Polycrystalline diamond constructions comprise a diamond body attached with a substrate during high pressure/high temperature processing, and include a modified reaction zone interposed between the body and substrate that is engineered to minimize or eliminate unwanted back diffusion of carbon from the diamond body into the substrate during the high pressure/high temperature processing.

20 Claims, 6 Drawing Sheets

(51) Int. Cl.

| | |
|---|---|
| ***E21B 10/573*** | (2006.01) |
| ***B22F 3/14*** | (2006.01) |
| ***C22C 29/06*** | (2006.01) |
| ***C22C 1/02*** | (2006.01) |
| ***C22C 29/08*** | (2006.01) |
| ***B22F 5/00*** | (2006.01) |
| ***B22F 7/08*** | (2006.01) |
| *E21B 10/50* | (2006.01) |
| *E21B 10/55* | (2006.01) |

(52) U.S. Cl.
CPC ..... *B24D 99/005* (2013.01); *C22C 1/02* (2013.01); *C22C 29/06* (2013.01); *C22C 29/08* (2013.01); *E21B 10/5735* (2013.01); *B22F 2005/001* (2013.01); *B22F 2302/10* (2013.01); *B22F 2302/406* (2013.01); *E21B 10/50* (2013.01); *E21B 10/55* (2013.01)

(58) Field of Classification Search
CPC ..... B22F 2302/10; B22F 2302/406; C22C 1/025; E21B 10/5735; E21B 10/50; E21B 10/55
USPC ..... 175/432
See application file for complete search history.

(56) References Cited

U.S. PATENT DOCUMENTS

| | | | |
|---|---|---|---|
| 2010/0126779 A1 | 5/2010 | Corbett et al. | |
| 2010/0212971 A1 | 8/2010 | Mukhopadhyay et al. | |
| 2011/0073380 A1* | 3/2011 | DiGiovanni ..... | B22F 7/064 175/432 |

OTHER PUBLICATIONS

International Preliminary Report on Patentability issued in International Patent application PCT/US2016/066050 dated Jul. 12, 2018, 15 pages.

* cited by examiner

POLYCRYSTALLINE DIAMOND CONSTRUCTIONS WITH MODIFIED REACTION ZONE

BACKGROUND

Polycrystalline diamond (PCD) materials and PCD elements formed therefrom are well known in the art. Conventional PCD is formed by combining diamond grains with a suitable solvent catalyst material and subjecting the diamond grains and solvent catalyst material to processing conditions of extremely high pressure/high temperature (HPHT). During such HPHT processing, the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive wear and cutting applications where high levels of wear resistance and hardness are desired.

Solvent catalyst materials that are typically used for forming conventional PCD include metals from Group VIII of the Periodic table, with cobalt (Co) being the most common. Conventional PCD can comprise from 85 to 95 percent by volume diamond and a remaining amount of the solvent catalyst material. The solvent catalyst material is present in the microstructure of the resulting PCD material within interstices or interstitial regions that exist between the bonded together diamond grains.

The solvent catalyst material may be provided during the HPHT process from a substrate that is to be joined together with the resulting PCD body, thereby forming a PCD compact. When subjected to the HPHT process, the solvent catalyst material within the substrate melts and infiltrates into the adjacent diamond grain volume to thereby catalyze the bonding together of the diamond grains. During such HPHT process, a reaction zone is formed adjacent the PCD body and substrate that includes constituents that infiltrate from the PCD body and/or the substrate. The presence of such reaction zone may weaken or embrittle the structure of the sintered PCD body especially near the interface with the substrate.

It is, therefore, desired that a polycrystalline diamond constructions be engineered in a manner so as to control the metallurgical properties in and near the reaction zone to thereby minimize or eliminate such unwanted weakness or embrittlement issues associated with conventional polycrystalline diamond constructions.

SUMMARY

Polycrystalline diamond constructions as disclosed herein may be provided in the form of a cutting element. An example cutting element construction includes a metallic substrate having an interface surface and a layer of powder material disposed onto the interface surface, where the powder material includes a carbide forming material. A volume of diamond powder is disposed onto the powder material so that the powder material is interposed between the metallic substrate and the diamond powder. Such construction is subjected to high pressure/high temperature processing for sintering the diamond body and attaching the diamond body to the substrate.

The carbide forming material is one capable of carburizing or reacting with carbon that diffuses from the diamond powder when the construction is subjected to the high pressure/high temperature processing for the purpose of forming a reaction zone that operates to minimize or eliminate unwanted back diffusion of carbon from the diamond body into the substrate. The carbide forming material may be selected from the group consisting of refractory metals selected from Groups IV through VII of the Periodic table, such as W, Mo, Ni, Cr, Zr, and combinations thereof. In an example, the powder material has a layer thickness of from about 0.1 to 40 micrometers. An adhesive material may be interposed between the layer of powder material and the metallic substrate interface surface. The layer of powder material may include from about 0.1 to 10 percent by volume of the total volume of the powder material and the volume of diamond powder. The construction may include more than one layer of powder material, wherein each layer includes a different carbide forming material.

The reaction zone formed during the high pressure/high temperature processing is interposed between the substrate and polycrystalline body and includes a carbide formed by reaction of the carbide forming material and carbon diffused from the diamond powder. In an example, the substrate is substantially free of any carbon diffused from the diamond volume.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

These and other features and advantages of polycrystalline diamond constructions as disclosed herein will be appreciated as the same becomes better understood by reference to the following description when considered in connection with the accompanying drawings wherein.

DESCRIPTION

Polycrystalline diamond constructions as disclosed herein include a diamond bonded body attached to a substrate, and are specifically engineered to have a reaction zone adjacent the interface of the body and the substrate that operates both to permit diffusion of a solvent metal catalyst from the substrate to a volume of diamond grains to facilitate sintering and formation of the diamond body at high pressure/high temperature conditions, and to minimize or eliminate unwanted diffusion of carbon from the diamond volume into the substrate. Such diffusion of carbon from the diamond volume into the substrate may weaken or embrittle the structure of conventional polycrystalline diamond constructions (not comprising the reaction zone as disclosed herein), especially near the interface between the diamond bonded body and substrate, which can cause the construction to fail, thereby reducing effective service life.

Additionally, while the reaction zone as engineered for constructions disclosed herein permits the diffusion of a solvent metal catalyst from the substrate to the volume of diamond grains during high pressure/high temperature processing conditions (for sintering of the diamond bonded body and attachment of the body to the substrate), such reaction zone also operates to temper and reduce the number and extent of eruptions of the solvent metal catalyst into the diamond grain volume during sintering, thereby improving uniformity in the material microstructure of the diamond bonded body adjacent the substrate interface, operating to strengthen the interface attachment to improve effective service life of the construction.

As used herein, the term "PCD" is used to refer to polycrystalline diamond that has been formed at HPHT conditions through the use of diamond grains or powder and an appropriate catalyst material. In an example embodiment, the catalyst material is a metal solvent catalyst that can include metals in Group VIII of the Periodic table. The solvent metal catalyst material is located within interstitial regions of the material microstructure after it has been sintered. However, as described in detail below, the PCD material may be treated to remove the catalyst material from a region thereof, or may be treated to remove the catalyst material from the entire diamond bonded body. As noted above, the polycrystalline diamond constructions as disclosed herein are formed using a high pressure/high temperature "HPHT" process condition, and include a specifically engineered reaction zone.

Figure 1:
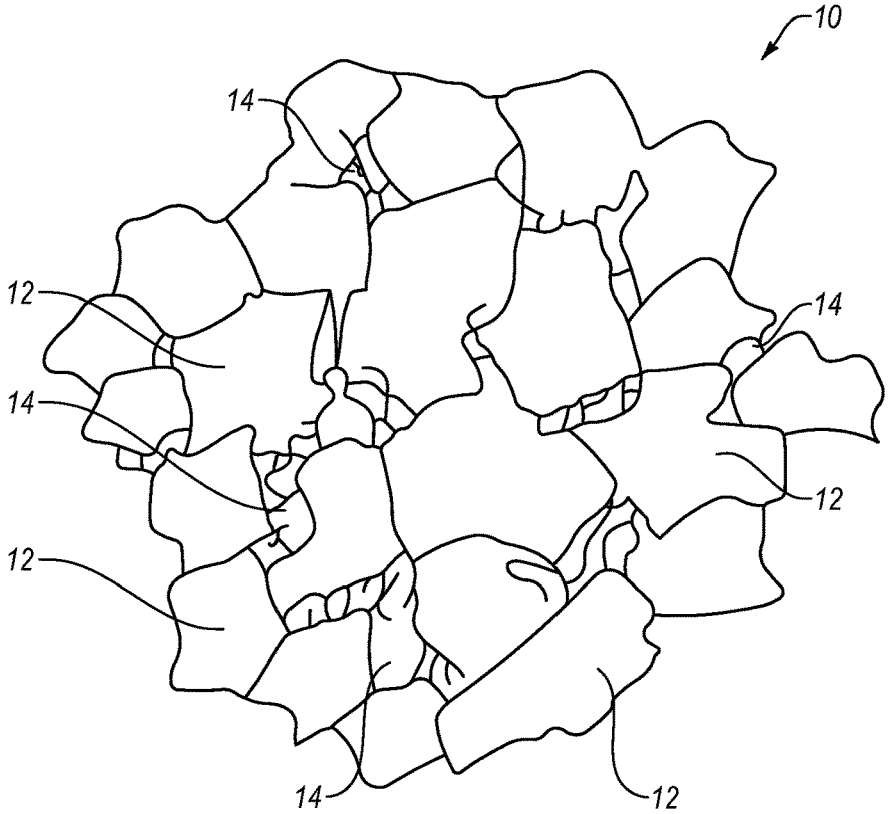
FIG. 1 is a schematic microstructural view of a region of a polycrystalline diamond construction, according to an embodiment of the invention.

FIG. 1 illustrates a region taken from a polycrystalline diamond construction 10 as disclosed herein, and that is shown to have a material microstructure comprising the following material phases. A polycrystalline matrix first material phase 12 comprises a plurality ultra-hard crystals formed by the bonding together of adjacent ultra-hard grains at HPHT conditions. A second material phase 14 is disposed interstitially between the bonded together ultra-hard crystals and comprises a catalyst material that is used to facilitate the bonding together of the ultra-hard crystals. The ultra-hard grains used to form the polycrystalline ultra-hard material can include those selected from the group of materials consisting of diamond, cubic boron nitride (cBN), and mixtures thereof. In an embodiment, the ultra-hard grains that are used are diamond and the resulting polycrystalline ultra-hard material is PCD.

As used herein, the term "catalyst material" is understood to refer to those materials that facilitate the bonding together of the ultra-hard grains during the HPHT process. When the ultra-hard material is diamond grains, the catalyst material facilitates formation of diamond crystals and/or the changing of graphite to diamond or diamond to another carbon-based compound, e.g., graphite.

In the example embodiment where the polycrystalline ultra-hard material is PCD, diamond grains used for forming the resulting diamond bonded body during the HPHT process include diamond powders having an average diameter grain size in the range of from submicrometer in size to about 0.1 mm, or, in another embodiment, in the range of from about 0.002 mm to about 0.08 mm. The diamond powder can contain grains having a mono or multi-modal size distribution. In an embodiment, the diamond powder has an average particle grain size of approximately 5 to 25 micrometers.

However, it is to be understood that the diamond grains having a grain size greater than or less than this amount can be used depending on the particular end use application. For example, when the polycrystalline ultra-hard material is provided as a compact configured for use as a cutting element for subterranean drilling and/or cutting applications, the particular formation being drilled or cut may impact the diamond grain size selected to provide desired cutting element performance properties. In the event that diamond powders are used having differently sized grains, the diamond grains are mixed together by conventional process, such as by ball milling or turbula mixing for as much time as necessary to ensure a substantially uniform mix and desired particle size distribution.

The diamond powder used to prepare the sintered diamond bonded body can be synthetic diamond powder. Synthetic diamond powder may include small amounts of solvent metal catalyst material and other materials entrained within the diamond crystals themselves. In another embodiment, the diamond powder used to prepare the diamond bonded body is natural diamond powder. The diamond grain powder, whether synthetic or natural, can be combined with a desired amount of catalyst material to facilitate desired intercrystalline diamond bonding during HPHT processing.

Suitable catalyst materials useful for forming the PCD body are metal solvent catalysts that include elements selected from the Group VIII of the Periodic table, e.g. cobalt (Co), and mixtures or alloys of two or more of these materials. In an embodiment, the diamond grain powder and catalyst material mixture includes from about 85 to 95 percent by volume diamond grain powder and the remaining amount catalyst material. In certain applications, the mixture can comprise greater than about 95 percent by volume diamond grain powder. In an embodiment, the solvent metal catalyst is introduced into the diamond grain powder by infiltration during HPHT processing from a substrate positioned adjacent the diamond powder volume.

In certain applications it may be desired to have a diamond bonded body comprising a single diamond-containing volume or region, while in other applications it may be desired that a diamond bonded body be constructed having two or more different diamond-containing volumes or regions. For example, it may be desired that the diamond bonded body include a first diamond-containing region extending a distance from a working surface, and a second diamond-containing region extending from the first diamond-containing region to the substrate. Such diamond-containing regions can be engineered having different diamond volume contents and/or be formed using differently sized diamond grains. It is, therefore, to be understood that polycrystalline diamond constructions as disclosed herein may include one or more regions comprising different ultra-hard component densities and/or grain sizes, e.g., diamond densities and/or diamond grain sizes, as called for by a particular cutting and/or wear end use application.

Figure 2:
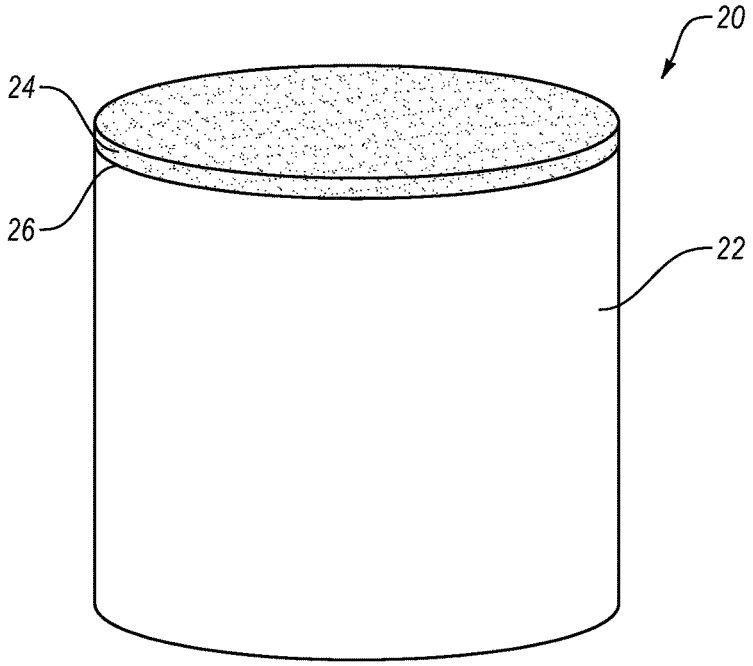
FIG. 2 is a perspective view of a polycrystalline diamond construction at one stage of a process used to make the same, according to an embodiment of the invention.

FIG. 2 illustrates an example polycrystalline diamond construction 20 as disclosed herein during an early stage of formation where a preformed/sintered substrate 22, e.g., a metallic substrate formed from cemented tungsten carbide or the like, is treated to include a layer of powder material 24 disposed over a top surface 26 of the substrate that will later interface with the diamond bonded body.

Suitable materials useful as the substrate 22 include those materials used as substrates for forming conventional PCD compacts, such as those formed from ceramic materials, metallic materials, cement materials, carbides, nitrides, and mixtures thereof. In an embodiment, the substrate is provided in a preformed rigid state and includes a metal solvent catalyst constituent that is capable of infiltrating into the adjacent diamond powder volume during HPHT processing to facilitate both sintering and providing a bonded attachment with the resulting sintered diamond bonded body. Suitable metal solvent catalyst materials include those selected from Group VIII elements of the periodic table as noted above. In an embodiment, the metal solvent catalyst is cobalt (Co), and the substrate material is cemented tungsten carbide (WC-Co).

In an example, the layer of powder material 24 is selected so as to react with or otherwise tie up or act as a getter for carbon diffusing from a volume of diamond powder later disposed onto the layer of powder material and subjected to HPHT processing. In an example, the powder material may be selected from materials including carbide formers. Such carbide-forming material may include refractory metals such as those selected from Groups IV through VII of the periodic table. Examples include W, Mo, Cr, Ni, Zr and the like.

In an example, the average grain size of the powder material used to form the layer 24 can and will vary depending on such factors as the type of powder material selected, the grain size and density of the diamond grains selected, the type of substrate selected, and the size, e.g., diameter, of the overall polycrystalline construction and the like. In an example, where the powder material used to form the layer is W, the average grain size may be greater than about 0.1 micrometers, from about 0.1 to 20 micrometers, about 1 to 10 micrometers, and approximately 3 micrometers.

The thickness of the powder material layer 24 can and will also vary depending on similar factors to those noted above. In an example, it is desired that the layer thickness is uniform across the substrate surface 26, and this is true whether the substrate has a planar surface or a nonplanar surface. In an embodiment, the thickness of the powder material layer be sufficient to form a reaction zone during HPHT processing of the construction so as to react with all of the carbon diffusing from the diamond volume in order to minimize or eliminate the carbon entering a region of the substrate outside of the reaction zone. It is also desired that the thickness be sufficient to temper and not prevent the diffusion of a solvent metal catalyst from the substrate in order to facilitate sintering of the diamond body while also minimizing the extent of any solvent metal catalyst eruptions into the diamond body to thereby minimize unwanted concentrated regions of the solvent metal catalyst projecting into the diamond body. In an example where the powder material used to form the layer is W, the layer thickness may be greater than about 0.1 micrometers, from about 0.1 to 40 micrometers, about 2 to 20 micrometers, and approximately 5 micrometers.

In an example, it may be desired that the surface 26 of the substrate 22 be treated or otherwise prepared for application of the powder material layer. Such treatment may include cleaning the surface using a chemical cleaning agent or by mechanical process to remove any unwanted impurities therefrom. Such treatment may include using a chemical adhesive agent or the like to ensure that the powder material layer is adhered thereto to limit spilling off of powder material for purposes of further processing. In an example, an adhesive agent is applied to the surface 26 prior to placement of the powder material layer. The adhesive agent that is used is one that can be volatized prior to HPHT processing as discussed below. In an example, the powder material layer can be applied by brush, spray, dip or other technique conventionally use for applying a layer of powder to a surface. Once applied, the layer of powder material may be treated to ensure a desired thickness, which process may include planing, e.g., using a straight edge or other instrument, to achieve a desired uniform thickness.

It is to be understood that the powder material layer as disclosed herein may be provided in the form of a single layer of one type of carbide forming material, multiple layers of the same type of carbide-forming material, a single layer including different types of carbide forming materials, or multiple layers of or different types of carbide forming materials.

Figure 3:
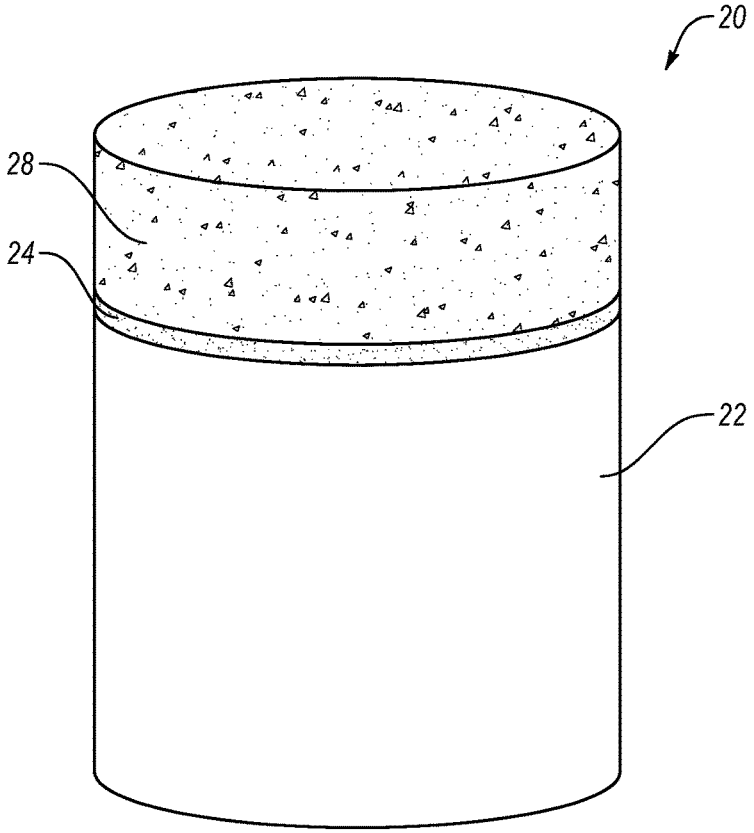
FIG. 3 is perspective view of a polycrystalline diamond construction at another stage of a process used to make the same, according to an embodiment of the invention.

FIG. 3 illustrates an example polycrystalline diamond construction 20 as disclosed herein during a further stage of formation subsequent to the stage of forming illustrated in FIG. 2. At this stage of formation, after the substrate 22 is treated to include the layer of powder material 24, a volume of diamond grains 28 is positioned adjacent to the substrate surface 26 such that the layer of powder material 24 is interposed between the substrate and the volume of diamond grains 28. While not illustrated, in an example, such process could take place with the substrate disposed in a HPHT container, such as a niobium can or the like that is conventionally used to form PCD compacts. Thus, the substrate would be disposed within the container, and the volume of diamond grains would be placed into the container on top of the substrate. In another embodiment, the diamond grains are loaded into the can first, and the substrate is then placed on top of the diamond grains so that the powder-prepped surface is in contact with the diamond grains. Other loading procedures are possible.

In an example, a measured volume of the diamond grains is cleaned, and loaded into a desired container where it is positioned adjacent the substrate surface. The diamond grains may be sized and arranged in the manner disclosed above to provide a diamond bonded body having desired properties for a particular end-use application. In an example, the volume of the diamond grains will influence the thickness or volume of the powder material layer, as a the powder material layer will form a reaction zone capable of reacting with or otherwise tying up carbon diffusing from the diamond grain volume during HPHT processing. For example, the volume of the powder material layer may be greater than about 0.1 percent, from about 0.1 to 10 percent, from about 1 to 6 percent, or approximately 2 percent of the total combined volume of the powder material layer and the diamond grain volume.

While example constructions and methods have been disclosed above with reference to FIGS. 2 and 3 with respect to the layer of powder material and volume of diamond grains, it is to be understood that other methods or manners of combining these materials with the substrate may be used with the scope of polycrystalline diamond constructions as disclosed herein. For example, as an alternative to applying the powder material layer onto the surface of the substrate and subsequent placement of the diamond grain volume thereon, one may load the substrate into the HPHT container, and then place a volume of material thereon that includes a first region of the powder material (for forming the reaction zone) and a second region of the diamond grains, wherein the first region is position in contact with the top surface of the substrate.

The loaded container is configured for placement within a suitable HPHT consolidation and sintering device. An advantage of combining a substrate with the diamond powder volume prior to HPHT processing is that the part that is produced is a compact that includes the substrate bonded to the sintered diamond bonded body to facilitate eventual attachment of the compact to a desired wear and/or cutting device by conventional method, e.g., by brazing or welding. Additionally, in an embodiment, the substrate is selected to include a metal solvent catalyst for catalyzing intercrystalline bonding of the diamond grains by infiltration during the HPHT process.

In an example embodiment, the HPHT device is activated to subject the container and its contents to HPHT conditions sufficient to melt the solvent metal catalyst in the substrate for diffusion through the powder metal layer and into the diamond grain volume. Alternatively, the solvent catalyst material may be mixed with the diamond grain volume and the substrate that is selected may or may not include a solvent metal catalyst. In an example, the HPHT device is controlled so that the container is subjected to a HPHT process comprising a pressure in the range of from 5 to 7 GPa and a temperature in the range of from about 1,320 to 1,600° C., for a period of time from about 50 to 500 seconds. During the HPHT process, the solvent metal catalyst melts and infiltrates into the diamond grain volume to facilitate intercrystalline diamond bonding. When the solvent metal catalyst source is the substrate, the solvent metal catalyst diffuses therefrom. The powder metal layer combines with carbon diffusing from the diamond grain volume forming a carbide and a reaction zone between the diamond body and the substrate that operates to prevent further migration of carbon out of the reaction zone and into the substrate.

The so-formed reaction zone also operates to temper or buffer the solvent metal catalyst diffusing from the substrate so as to control the amount and magnitude of unwanted catalyst eruptions into the diamond grain volume and resulting sintered diamond body. Thus, in an embodiment, the powder material layer operates to form a reaction zone that does not act as a barrier to prevent solvent metal catalyst diffusion into the diamond grain volume. During this HPHT process, the powder material layer, e.g., when in the form of W, also operates to provide a source of W in addition to or in place of that in the substrate for diffusing into the diamond grain volume for purposes of forming a strong bond with the substrate. Reducing or eliminating the diffusion of W from the substrate thereby ensures a strong interfacing attachment with the sintered diamond body. If desired, the power material layer may be formed from metals that are different from the metal (e.g., W) in the substrate that may also form a reaction zone that operates in a similar manner to that described above.

Figure 4:
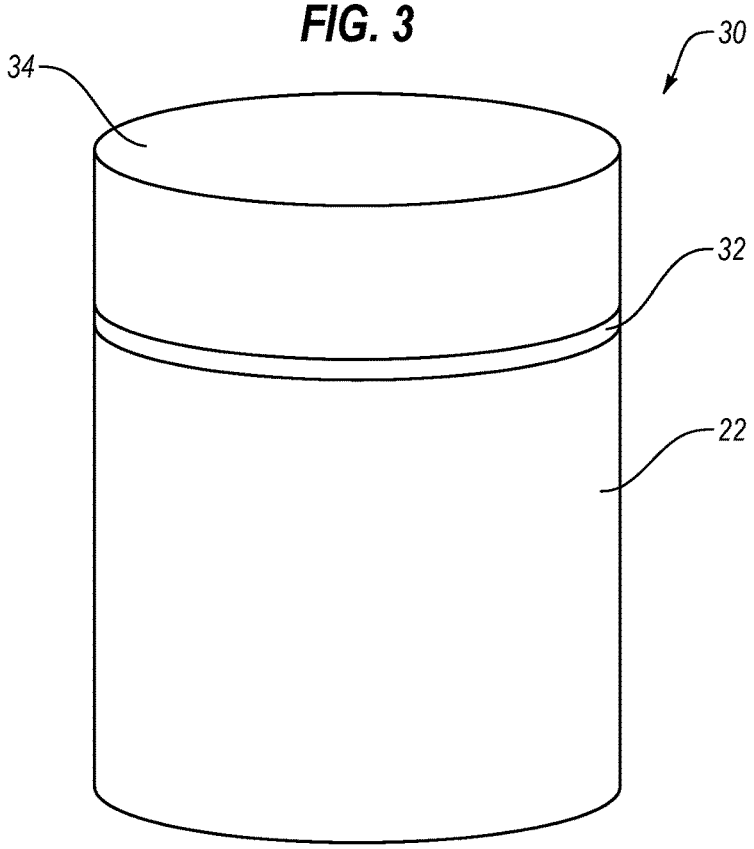
FIG. 4 is a perspective view of a polycrystalline diamond construction at another stage of a process use to make the same, according to an embodiment of the invention.

FIG. 4 illustrates an example polycrystalline diamond construction 30 as disclosed herein after it has been formed by the HPHT process described above. The construction 30 comprises the substrate 22, a reaction zone 32, and a sintered diamond bonded body 34 comprising polycrystalline diamond, wherein the reaction zone is interposed between the substrate and the diamond bonded body 34. In an example, the reaction zone 32 may extend a partial depth into one or both of the substrate 22 and the diamond bonded body 34. As noted above, the reaction zone 32 comprises carbide formed by reaction of the powder metal material and carbon diffused from the diamond grains during HPHT processing, and may also include residual carbide-forming material and/or solvent catalyst material. Especially in the substrate, the addition of the metal powder layer at the interface to form the reaction zone reduces the back-diffusion of carbon into the substrate, which carbon if otherwise allowed to diffuse would operate to reduce the strength of the tungsten carbide substrate.

In an example, the reaction zone has a thickness in the construction that is at least about 0.005 micrometers, from about 0.005 to 50 micrometers, from about 0.01 to 30 micrometers, or approximately 5 micrometers.

Figure 5:
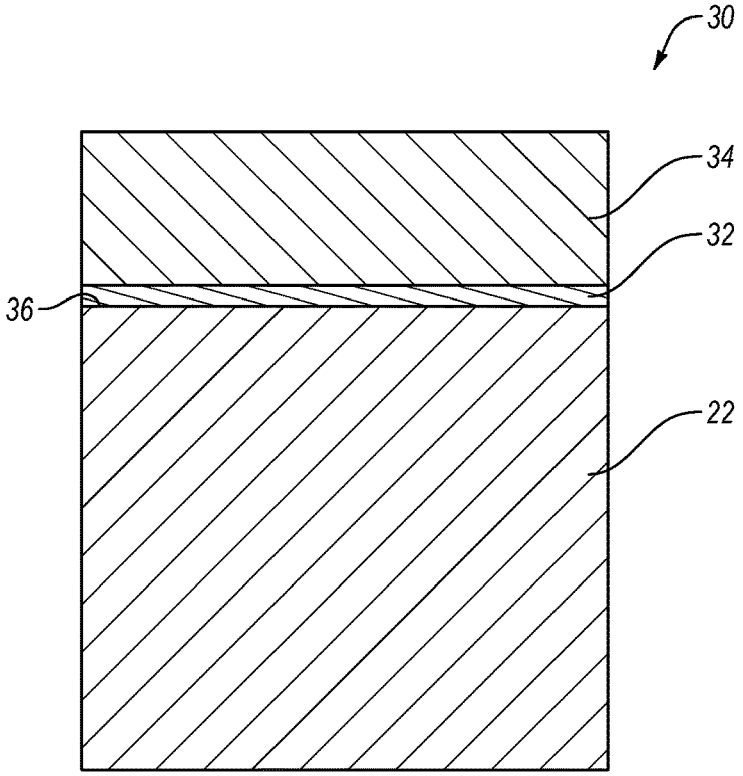
FIG. 5 is a cross-sectional side view of a polycrystalline diamond construction, according to an embodiment of the invention.

FIG. 5 is a cross-section view of the example polycrystalline diamond construction 30 of FIG. 4, illustrating the substrate 22, the reaction zone 32, and the diamond bonded body 34. A feature of the construction 30 of this particular example is that the substrate 22 has an interface surface 36 that is planar. It is to be understood that polycrystalline diamond constructions as disclosed herein may comprise substrate having nonplanar interface surface.

Figure 6:
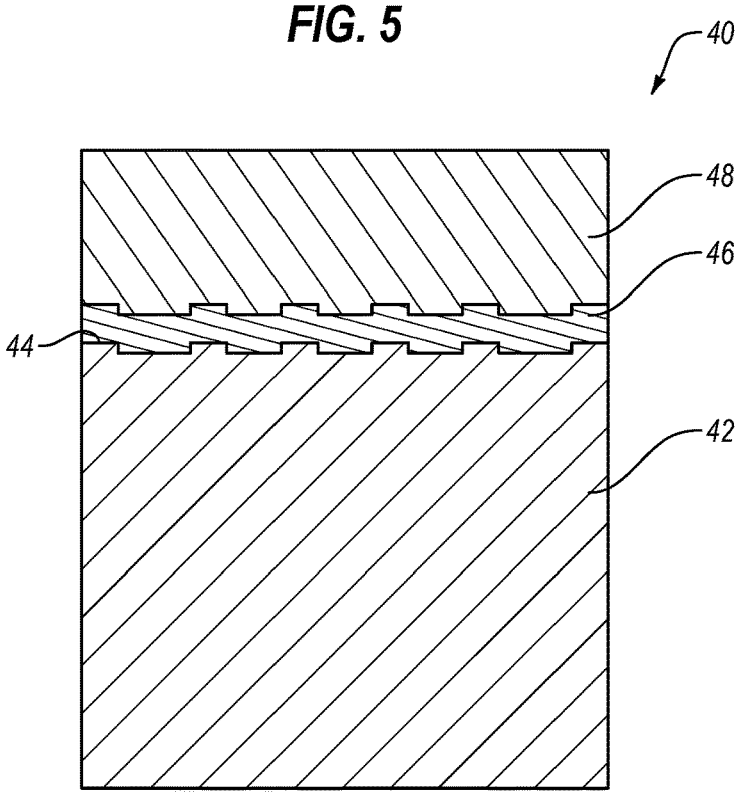
FIG. 6 is a cross-sectional side view of the a polycrystalline diamond construction, according to an embodiment of the invention.

FIG. 6 illustrates an example polycrystalline diamond construction 40 as disclosed herein comprising a substrate 42 having a nonplanar interface surface 44, and a reaction zone 46 interposed between the substrate 42 and a diamond bonded body 48. While FIG. 6 illustrates a construction 40 comprising a substrate 42 having a particular nonplanar interface surface 44, e.g., it is to be understood that constructions as disclosed herein are intended to include and be used with substrates comprising any non-planar interface surface.

If desired, e.g., for certain end-use applications calling for an improved degree of thermal stability, it may be desired that the diamond bonded body be treated to remove the catalyst material from the interstitial regions of a selected region of the body. This can be done, for example, by removing substantially all of the catalyst material from the selected region by suitable process, e.g., by acid leaching, aqua regia bath, electrolytic process, chemical processes, electrochemical processes, ultrasonic processes, or combinations thereof.

It is desired that the selected region where the catalyst material is to be removed, or the region of the diamond bonded body that is to be rendered substantially free of the catalyst material, be one that extends a determined depth from a surface, e.g., a working or cutting surface, of the diamond bonded body independent of the working or cutting surface orientation. Again, it is to be understood that the working or cutting surface may include more than one surface portion of the diamond bonded body that may be a top and/or side surface of the diamond bonded body.

In an example, it is desired that the region rendered substantially free of the catalyst material extend from a working or cutting surface of the diamond bonded body to a depth that is calculated to be sufficient to provide a desired improvement in thermal stability to the diamond body. Thus, the exact depth of this region is understood to vary depending on such factors as the diamond density, the diamond grain size, the ultimate end use application, and the desired increase in thermal stability.

In an example, the region can extend from the working surface to an average depth of at least about 0.02 millimeters, from about 0.02 millimeters to about 0.1 millimeters, or from about 0.04 millimeters to an average depth of about 0.08 millimeters. In another example, e.g., for more aggressive tooling, cutting and/or wear applications where an even greater degree of thermal stability is sought, the region rendered substantially free of the catalyst material can extend a depth from the working surface of greater than about 0.1 millimeters, e.g., from about 0.45 to 0.6 millimeter or more.

The targeted region for removing the catalyst material can include any surface region of the diamond bonded body, including, and not limited to, the diamond table, a beveled section extending around and defining a circumferential edge of the diamond table, and/or a sidewall portion extending axially a distance away from the diamond table towards or to the substrate interface. Accordingly, in an example, the region rendered substantially free of the catalyst material can extend along the diamond table and then around the sidewall surface of the diamond bonded body a distance that may reach the substrate interface.

It is to be understood that the depth of the region removed of the catalyst material is represented as being a nominal, average value arrived at by taking a number of measurements at preselected intervals along this region and then determining the average value for all of the points. The remaining/untreated region of the diamond bonded body is understood to still contain the catalyst material uniformly distributed therein, and comprises the polycrystalline diamond material described above.

Additionally, when the diamond bonded body is treated, the selected depth of the region to be rendered substantially free of the catalyst material may be one that allows a sufficient depth of remaining PCD so as to not adversely impact the attachment or bond formed between the diamond bonded body and the substrate. In an example, it is desired that the untreated or remaining PCD region within the diamond bonded body have a thickness of at least about 0.01 millimeters as measured from the substrate interface. It is, however, understood that the exact thickness of the remaining PCD region can and will vary from this amount depending on such factors as the size and configuration of the compact, and the particular PCD compact application.

Figure 7:
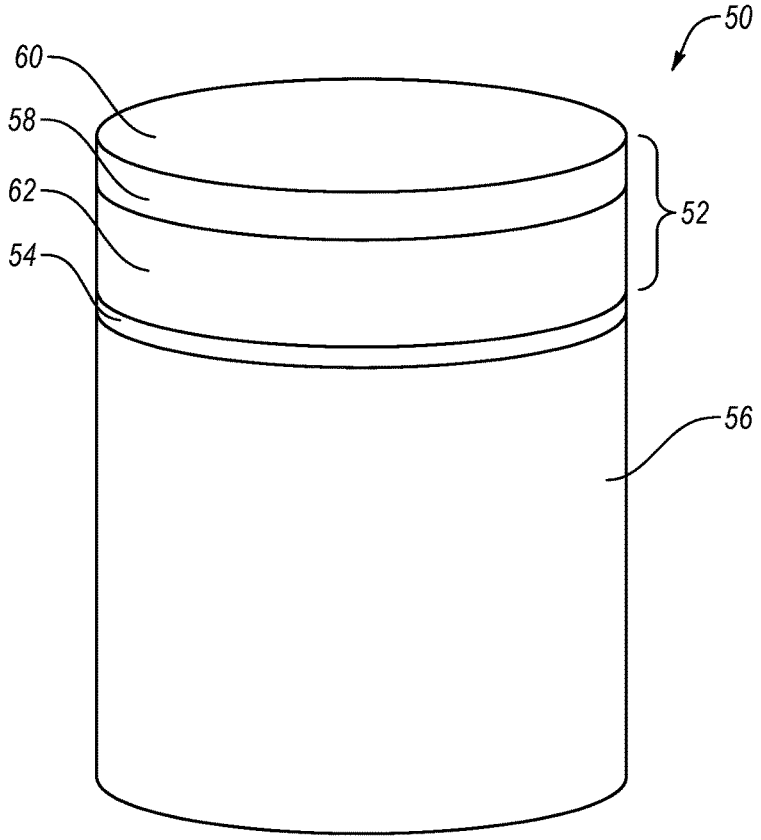
FIG. 7 is a perspective view of a polycrystalline diamond construction, according to an embodiment of the invention.

FIG. 7 illustrates an example polycrystalline diamond construction 50 comprising a diamond bonded body 52, a reaction zone 54 interposed between the body 52 and the substrate 56, wherein a region of the diamond bonded body 58 extending a partial depth from the body top surface 60 has been treated as noted above and rendered thermally stable, thereby forming a thermally stable region. The remaining region 62 of the diamond bonded body extending from the thermally stable region 58 to the reaction zone is polycrystalline diamond forming a polycrystalline diamond region 62.

If desired, polycrystalline diamond constructions as disclosed herein may be formed such that the entire diamond bonded body is rendered thermally stable. In such an example, the thermally stable diamond body may be formed by first forming a polycrystalline diamond body in the manner noted above, by subjecting a volume of diamond grains to a HPHT process to sinter the diamond grains in the presence of a solvent metal catalyst. The source of the solvent metal catalyst may diffuse from a substrate during the HPHT process, e.g., such as one of the substrates disclosed above. In such example, the substrate would be sacrificial as it would be used as the catalyst source and the powder material layer would not be used in forming the PCD compact comprising the joined diamond bonded body and substrate. In such example, once the PCD compact is formed, the entire diamond body would be treated to render it thermally stable, in which case the substrate would either be removed before or after the treatment process, leaving the thermally stable polycrystalline diamond body or "TSP" body. Alternatively, the solvent metal catalyst may be mixed together with the diamond grains, in which case a substrate is not used and the diamond grain and solvent metal catalyst mixture is subjected to HPHT process to form the sintered PCD body. The resulting entire PCD body would then be treated to render it thermally stable, forming a TSP body.

Once the TSP body is formed, a powder metal layer as disclosed above would be applied to a substrate, and TSP body would be positioned adjacent the powder metal layer, and the combination would be subjected to an HPHT process for the purpose of attaching the TSP body to the substrate. The resulting construction would look like the example shown in FIG. 4, and comprise a reaction zone interposed between the TSP body and the substrate. The powder metal layer would function in the same manner disclosed above to capture carbon diffusing from the TSP body during HPHT processing, and would temper solvent metal catalyst material diffusing from the substrate so as to minimize the amount and magnitude of unwanted eruptions into the TSP body.

A feature of polycrystalline diamond constructions as disclosed herein is the presence of a reaction zone that has been intentionally engineered for purposes of minimizing or eliminating unwanted diffusion of carbon from the diamond body during HPHT processing, while still permitting a desired diffusion of a solvent metal catalyst from the substrate to facilitate sintering of the diamond body, wherein such solvent metal catalyst diffusion is controlled so as to minimize the amount and magnitude of catalyst eruptions into the diamond body. Accordingly, such reaction zone operates to provide an improved degree of bond strength between the diamond body (that is not otherwise weakened by carbon diffusion into the catalyst depleted region of the substrate known to cause embrittlement in conventional diamond bonded constructions), and also a reduce degree of unwanted catalyst eruptions into the diamond body.

Polycrystalline diamond constructions as disclosed herein may be used in a number of different applications, such as tools for mining, cutting, machining and construction applications. Polycrystalline diamond constructions as disclosed herein are particularly well suited for use as working, wear and/or cutting components in machine tools and drill and mining bits, such as roller cone rock bits, percussion or hammer bits, diamond bits, and shear cutters used for drilling subterranean formations.

Figure 8:
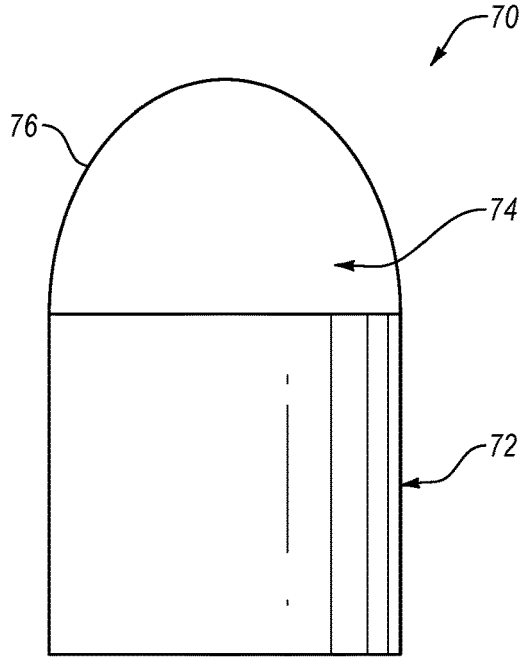
FIG. 8 is a perspective side view of an insert, for use in a roller cone or a hammer drill bit, comprising the polycrystalline diamond construction as disclosed herein, according to an embodiment of the invention.

FIG. 8 illustrates an embodiment of a polycrystalline diamond construction as disclosed herein in the form of an insert 70 used in a wear or cutting application in a roller cone drill bit or percussion or hammer drill bit. For example, such inserts 70 can be formed from blanks comprising a substrate 72 formed from one or more of the substrate materials disclosed above, and a diamond bonded body 74 having a working surface 76. The blanks are pressed or machined to the desired shape of a roller cone rock bit insert.

Figure 9:
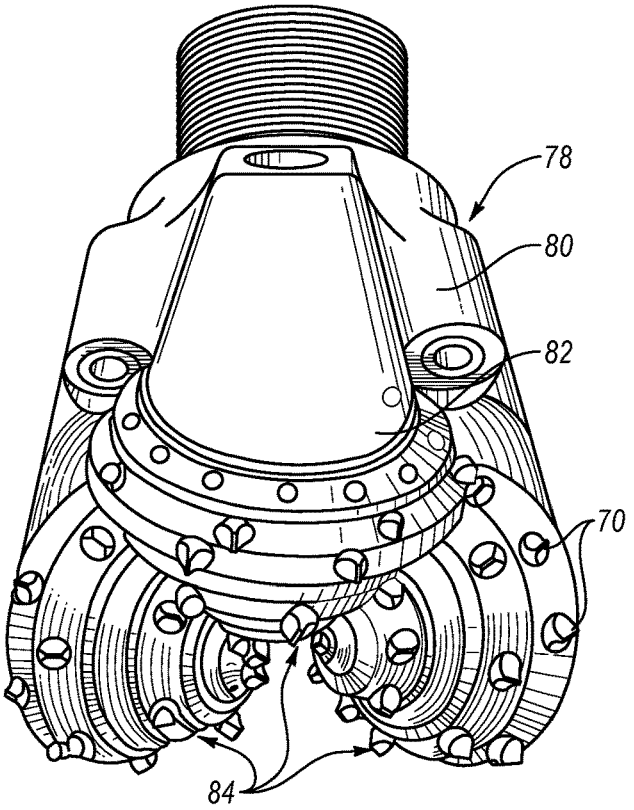
FIG. 9 is a perspective side view of a roller cone drill bit comprising a number of the inserts of FIG. 8, according to an embodiment of the invention.

FIG. 9 illustrates a rotary or roller cone drill bit in the form of a rock bit 78 comprising a number of the wear or cutting inserts 70 disclosed above and illustrated in FIG. 8. The rock bit 78 comprises a body 80 having three legs 82, and a roller cutter cone 84 mounted on a lower end of each leg. The inserts 70 can be fabricated according to the method described above. The inserts 70 are provided in the surfaces of each cutter cone 84 for bearing on a rock formation being drilled.

Figure 10:
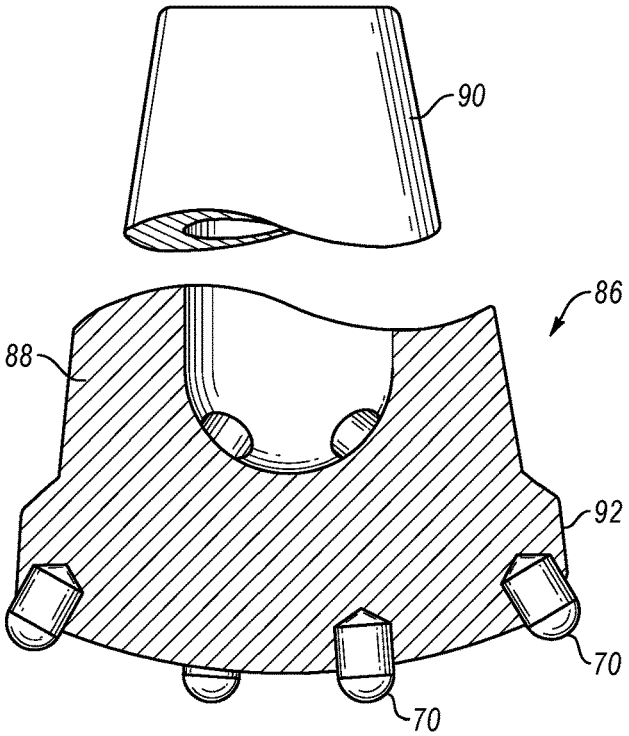
FIG. 10 is a perspective side view of a percussion or hammer bit comprising a number of inserts of FIG. 8, according to an embodiment of the invention.

FIG. 10 illustrates the inserts 70 described above as used with a percussion or hammer bit 86. The hammer bit comprises a hollow steel body 88 having a threaded pin 90 on an end of the body for assembling the bit onto a drill string (not shown) for drilling oil wells and the like. A plurality of the inserts 70 is provided in the surface of a head 92 of the body 88 for bearing on the subterranean formation being drilled.

Figure 11:
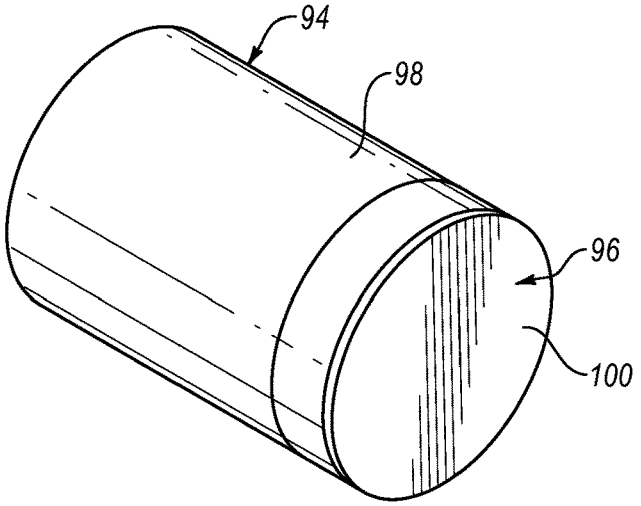
FIG. 11 is a schematic perspective side view of a shear cutter comprising the polycrystalline diamond construction as disclosed herein, according to an embodiment of the invention.

FIG. 11 illustrates a polycrystalline diamond construction as disclosed herein embodied in the form a shear cutter 94 used, for example, with a drag bit for drilling subterranean formations. The shear cutter 94 comprises a diamond bonded body 96 that is sintered or otherwise attached to a cutter substrate 98. The diamond bonded body 96 includes a working or cutting surface 100.

Figure 12:
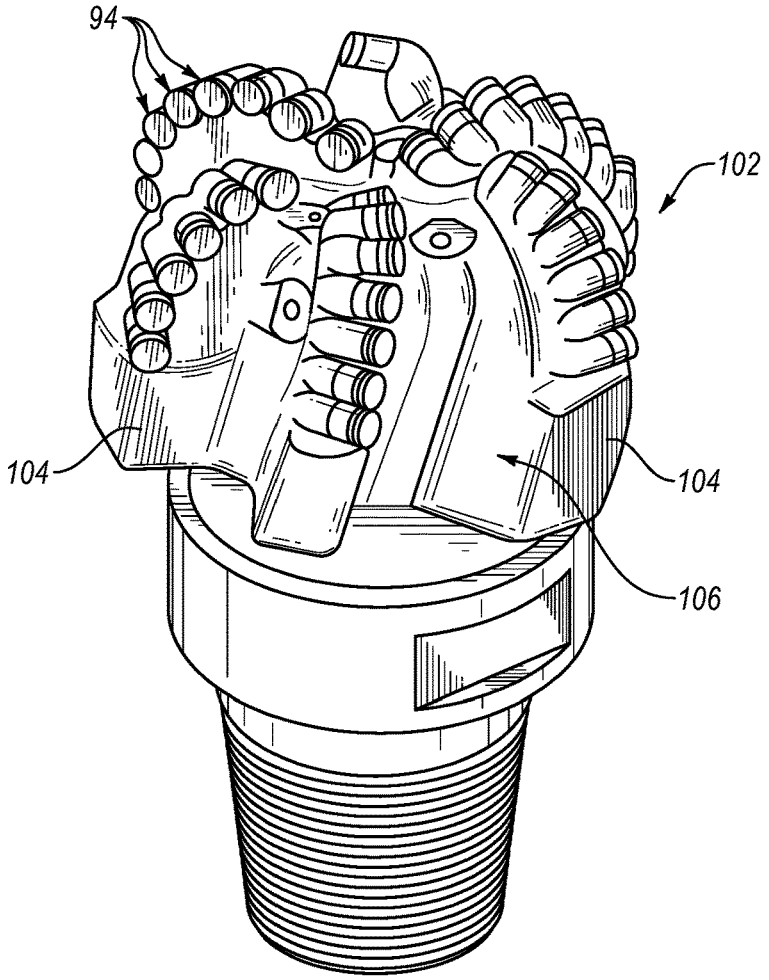
FIG. 12 is a perspective side view of a drag bit comprising a number of the shear cutters of FIG. 11, according to an embodiment of the invention.

FIG. 12 illustrates a drag bit 102 comprising a plurality of the shear cutters 94 described above and illustrated in FIG. 11. The shear cutters are each attached to blades 104 that extend from a head 106 of the drag bit for cutting against the subterranean formation being drilled.

Although only a few example embodiments of polycrystalline diamond constructions, method for making the same, and devices comprising the same have been described in detail above, those skilled in the art will readily appreciate that many modifications are possible in the example embodiments without materially departing from the concepts as disclosed herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A cutting element construction comprising:

a metallic substrate having an interface surface;

a layer of powder material disposed onto the metallic substrate interface surface, powder material comprising a carbide forming material; and a volume of diamond powder disposed directly onto the powder material so that the powder material is interposed between the metallic substrate and the diamond powder.

2. The cutting element construction as recited in claim 1 wherein the carbide forming material is one capable of carburizing or reacting with carbon that diffuses from the diamond powder when the construction is subjected to a high pressure/high temperature process condition.

3. The cutting element construction as recited in claim 1 wherein the carbide forming material is selected from the group consisting of refractory metals selected from Groups IV through VII of the Periodic table.

4. The cutting element construction as recited in claim 1 wherein powder material has a layer thickness of from about 0.1 to 40 micrometers.

5. The cutting element construction as recited in claim 1 further comprising an adhesive material interposed between the layer of powder material and the metallic substrate interface surface.

6. The cutting element construction as recited in claim 1 wherein the layer of powder material comprises from about 0.1 to 10 percent by volume of the total volume of the powder material and the volume of diamond powder.

7. The cutting element construction as recited in claim 1 comprising more than one layer of powder material, wherein each layer comprises a different carbide forming material.

8. The cutting element construction as recited in claim 1 wherein after subjecting the construction to a high pressure/high temperature process condition to sinter the diamond powder to form a polycrystalline body, the construction comprises a reaction zone that is interposed between the substrate and polycrystalline body that comprises a carbide formed by reaction of the carbide forming material and carbon from the diamond powder.

9. The cutting element construction as recited in claim 8 wherein the substrate is substantially free of any carbon diffused from the diamond volume.

10. The cutting element construction as recited in claim 1 wherein the layer of powder material has a substantially uniform thickness.

11. A polycrystalline diamond cutting element construction comprising:

a diamond body comprising a matrix of intercrystalline bonded-together diamond, and a plurality of interstitial regions disposed within the matrix;

a metallic substrate that is connected with the diamond body during a high pressure/high temperature process condition used to form the diamond body; and a reaction zone interposed between the diamond body and the metallic substrate and that extends a partial depth into the diamond body and metallic substrate, the reaction zone comprising a carbide formed between a carbide-former present in powder form before the high pressure/high temperature process condition, and comprising carbon diffused from a volume of diamond powder during the high pressure/high temperature process condition used to form the diamond body, wherein the powder containing the carbide-former is interposed between the volume of diamond powder and the metallic substrate prior to the high pressure/high temperature process condition;

wherein the carbon that has diffused from the volume of diamond powder is contained in the reaction zone and the remaining region of the metallic substrate is substantially free of the diffused carbon.

12. The polycrystalline diamond cutting element as recited in claim 11 wherein the diamond body is formed in the presence of a solvent metal catalyst diffused from the substrate during the high pressure/high temperature process condition.

13. The polycrystalline diamond cutting element as recited in claim 11 wherein the reaction zone has a thickness of from about 0.005 to 50 micrometers.

14. The polycrystalline diamond cutting element as recited in claim 11 wherein the carbide-former is provided separately from the substrate and is tungsten, the carbide is tungsten carbide, and wherein the substrate comprises tungsten carbide separately from the reaction zone.

15. A method for making a polycrystalline diamond construction comprising:

placing a volume of diamond grains adjacent to a metallic substrate, wherein a layer of carbide-forming powder is interposed between an interface surface of the metallic substrate and the volume of diamond grains, the volume of diamond grains, layer of carbide-forming powder, and metallic substrate forming an assembly; and subjecting the assembly to a high pressure/high temperature process condition to sinter the diamond volume in the presence of a solvent metal catalyst to form a diamond body, to attach the body to the substrate, and to form a reaction zone by reaction of the carbide-forming powder with carbon diffusing from the diamond body.

16. The method as recited in claim 15 wherein the carbide-forming powder is a refractory metal selected from Groups IV through VII of the periodic table.

17. The method as recited in claim 15 wherein the layer of carbide-forming powder comprises from about 0.1 to 10 percent by volume of the total volume of the carbide-forming powder and the volume of diamond grains.

18. The method as recited in claim 17 wherein the layer of carbide-forming powder has a thickness of from about 0.1 to 40 micrometers.

19. The method as recited in claim 15 wherein after subjecting the assembly to a high pressure/high temperature process condition, the metallic substrate is substantially free of carbon outside of the reaction zone diffused from the diamond body.

20. The method as recited in claim 15 wherein the reaction zone extends a partial depth into the diamond body.

* * * * *